United States Patent [19]

Booman et al.

[11] Patent Number: 4,775,244

[45] Date of Patent: Oct. 4, 1988

[54] METHOD AND APPARATUS FOR MEASUREMENT OF PULSE WIDTH OF VERY SHORT PULSES

[75] Inventors: Richard A. Booman; Stephen F. Blazo, both of Portland, Oreg.

[73] Assignee: Tektronix, Inc., Beaverton, Oreg.

[21] Appl. No.: 58,447

[22] Filed: Jun. 5, 1987

[51] Int. Cl.[4] ..... G04F 8/00

[52] U.S. Cl. ..... 368/120

[58] Field of Search ..... 368/120, 121, 117, 118; 324/71, 76 A, 142

[56] References Cited

U.S. PATENT DOCUMENTS 3,896,378 7/1975 Bedford ..... 368/120

*Primary Examiner*—Bernard Roskoski

*Attorney, Agent, or Firm*—George T. Noe; William O. Geny; Francis I. Gray

[57] ABSTRACT

A method and apparatus for measuring the width of pulses in the gigahertz range comprises the steps of splitting an input pulse and delaying one of the pulses prior to their recombination in a directional coupler. The recombined pulse is then measured in a power meter. By varying the delay, maximum and minimum readings from the power meter may be found. The pulse width may then be found as a function of the actual delay, which may be controlled by the user by varying the distance through a waveguide that the delayed pulse must travel.

4 Claims, 1 Drawing Sheet

METHOD AND APPARATUS FOR MEASUREMENT OF PULSE WIDTH OF VERY SHORT PULSES

BACKGROUND OF THE INVENTION

The following invention relates to a method and apparatus for measuring the widths of very short pulses such as those that might be encountered in communication and computing systems that have frequencies in the gigahertz range.

A problem frequently encountered by measuring instruments which are used to measure the electrical properties of computing and communications equipment is that given the frequencies at which such equipment operates, the pulse widths of information signals generated within such equipment are very short. For some applications it is frequently necessary to know or to be able to characterize the width of these very short pulses, which have widths on the order of $10^3$-$10^2$ picoseconds or less. Heretofore such measurements have only been possible in very expensive digital sampling oscilloscopes.

SUMMARY OF THE INVENTION

The present invention provides a relatively inexpensive method and apparatus for measuring very short pulses. The pulses are received on a transmission line input which is connected to a directional coupler or power splitter. One pulse is fed through a variable time delay and connected to a second directional coupler while the other pulse is connected directly to the second directional coupler. The delayed pulse and the non-delayed pulse are algebraically added to form a recombined pulse which is fed to a power meter. The power meter measures the average power of the recombined pulse over a predetermined time interval. This provides the autocorrelation of the input pulse as a function of the time delay.

The variable time delay may comprise a wave guide having a movable segment for introducing the predetermined time delay. The autocorrelation function will vary as the segment is moved from a maximum where there is complete overlap between the delayed and nondelayed pulses, to a minimum where there is no overlap. The distance the segment is moved can be translated to a known time delay. Thus, observing the change in the power of the input signal as a function of the distance the segment is moved provides an indication of the autocorrelation function as a function of time, because the propagation time through the segment may be calculated based upon the change in distance. From this data the width of the input pulse may be derived.

It is a principal object of this invention to provide a network for measuring the pulse widths of very short pulses.

A further object of this invention is to provide a network for determining the autocorrelation function of an input pulse to thereby calculate the pulse width of the input pulse.

Yet a further object of this invention is to provide a simple and inexpensive network for characterizing the widths of input pulses with a resolution of one picosecond.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
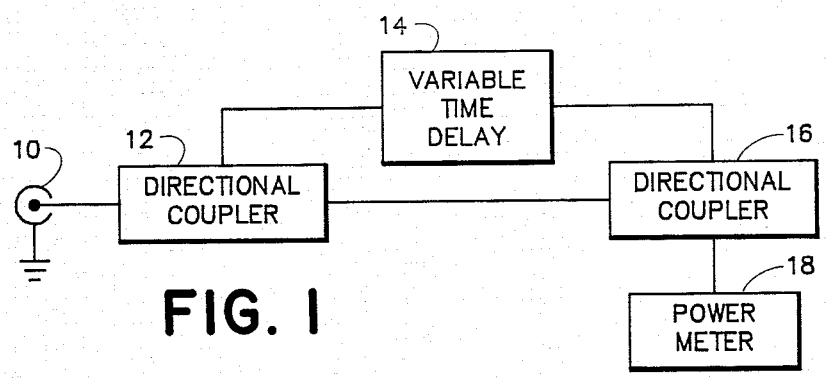
FIG. 1 is a block schematic diagram of the network of the present invention.

Referring now to FIG. 1, a transmission line input 10 is coupled to a first directional coupler 12. The directional coupler 12 has two outputs, one of which forms an input to variable time delay 14. The other output of directional coupler 12 is an input to second directional coupler 16. The output of the variable time delay 14 is connected to a second input of directional coupler 16. The output of directional coupler 16 forms the input to power meter 18.

Figure 2:
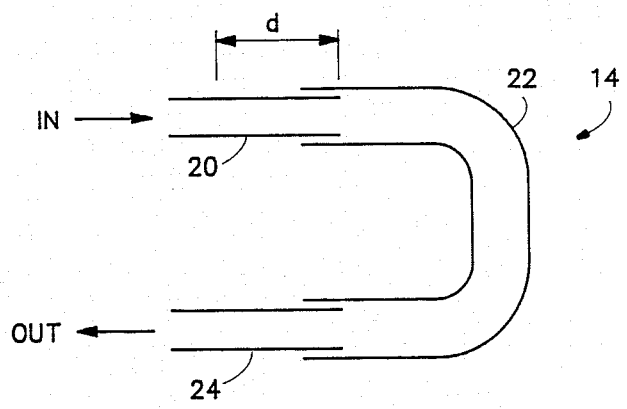
FIG. 2 is a schematic diagram of an adjustable wave guide which provides the variable time delay of FIG. 1.

The variable time delay 14 of FIG. 1 is shown in more detail schematically in FIG. 2. An input 20 which may, for example, be a slotline wave guide is connected to a movable wave guide segment 22 which comprises a generally U-shaped member. The segment 22 feeds the input from slot line 20 to a similar fixed output slot line 24. The movable member 22 may be moved in the direction of the arrows a distance "D" or increments thereof as indicated in FIG. 2. Moving the slotline member 22 to shorten its effective length, that is toward the left in FIG. 2, will result in a shorter time delay than will moving the member 22 to the right. This is because the time delay $\tau$ is equal to the distance D divided by the speed of the microwave in the medium through which it travels. Thus, $\tau = D\epsilon/C$, where epsilon is a constant and C is the speed of light.

According to the method of the invention, an input pulse entering directional coupler 12 is split into two signals. One signal enters the variable time delay 14 and the other is routed directly to directional coupler 16. A variable time delay $\tau$ is introduced by the user. The two signals recombine algebraically in the directional coupler 16 and their average power over a predetermined time interval is measured by power meter 18. The autocorrelation of the input pulse may thus be measured as a function of the time delay. Since the power meter 18 measures the average of the square of the input voltage:

$$f(\tau) = \int_{-\infty}^{+\infty} [V(t) + V(t-\tau)]^2\, dt, \text{ and}$$

$$f(\tau) = \int_{-\infty}^{+\infty} V(t)^2 + V^2(t-\tau) + 2V(t)V(t-\tau)\, dt,$$

thus, $$f(\tau) = K + 2 \int_{-\infty}^{+\infty} V(t)V(t-\tau)\, dt.$$

K is a constant and the term inside the integral is the autocorrelation function. This function will be at a maximum when $\tau = 0$ (complete overlap between delayed and nondelayed pulses) and at a minimum (no overlap) when $\tau = t$. By observing the power meter while the segment 22 is moved a distance D, the user may note the position of the segment 22 when $f(\tau)$ is at a maximum and minimum, respectively. If a maximum occurs at a distance $d_1$ and a minimum occurs at a distance $d_2$ then the time delay is the actual measure of the pulse width. The pulse width is directly related to $\tau$ which can be calculated because $$\tau = \frac{(d_1 - d_2)}{C} \epsilon.$$

The terms and expressions which have been employed in the foregoing specification are used therein as terms of description and not of limitation, and there is no intention, in the use of such terms and expressions, of excluding equivalents of the features shown and dscribed or portions thereof, it being recognized that the scope of the invention is defined and limited only by the claims which follow.

We claim:

1. A network for measuring the width of very short pulses comprising:

(a) a single transmission line input for receiving said very short pulses for measurement connected to a first directional coupler;

(b) said first directional coupler having a first output connected to variable time delay means for introducing time delay in said pulses and having a second output connected to a first input of a second directional coupler, said variable time delay means having an output connected to a second input of said second directional coupler whereby delayed and undelayed pulses are combined therein; and (c) power measurement means connected to an output of said second directional coupler for determining the average over a predetermined time interval of the square of a voltage output of said second directional coupler.

2. The network of claim 1 wherein said variable time delay means comprises a waveguide having a movable segment for introducing said time delay by altering the length of the path traveled by said pulses.

3. A method of determining the pulse width of a very short pulse comprising the steps of:

(a) splitting said pulse so as to create two pulses, each having substantially the same pulse width;

(b) subjecting one of said pulses to a variable time delay;

(c) recombining both of said pulses to form a single pulse;

(d) measuring the average square of the voltage of said single pulse over a predetermined time interval;

(e) observing the amplitude of the measurement of step (d) as said time delay is varied to find the maximum and minimum amplitudes; and (f) calculating the pulse width by determining the actual time delay of said pulse.

4. The method of claim 3 wherein step (b) is performed by altering the length of a variable length transmission line through which said one of said pulses travels.

* * * * *